United States Patent [19]

Hebard

[11] Patent Number: 4,934,710

[45] Date of Patent: Jun. 19, 1990

[54] EDUCATIONAL GAME EMPHASIZING HARMONY

[76] Inventor: Harry R. Hebard, Box 31, Plymouth, Wis. 53073

[21] Appl. No.: 282,745

[22] Filed: Dec. 12, 1988

[51] Int. Cl.[5] ..... A63F 3/02; A63F 3/00

[52] U.S. Cl. ..... 273/258; 273/290

[58] Field of Search ..... 273/250–255, 273/258, 260–262

[56] References Cited

U.S. PATENT DOCUMENTS

| | | | |
|---|---|---|---|
| 1,095,433 | 5/1914 | Stevens | 273/254 |
| 1,405,988 | 2/1922 | Erwin | 273/260 |
| 2,729,451 | 1/1956 | Larson | 273/239 |
| 3,347,550 | 10/1967 | Carboni | 273/282 |
| 3,810,615 | 5/1974 | Miller | 273/1 E |
| 4,004,809 | 1/1977 | Schreiber | 273/290 |
| 4,753,441 | 6/1988 | Braus et al. | 273/255 |

FOREIGN PATENT DOCUMENTS

| | | | |
|---|---|---|---|
| 2341335 | 9/1977 | France | 273/254 |
| 19662 | 6/1901 | United Kingdom | 273/262 |

*Primary Examiner*—Benjamin Layno

*Attorney, Agent, or Firm*—Leon Gilden

[57] ABSTRACT

An educational game is set forth wherein the object of the game is to press the teaching of harmonious interaction between the players as opposed to planned conflict. The game presents opposed spaced villages of representative tokens to traverse the game board acquiring the necessary items to enter the opposite home spacing vacated by an opposing player. Various hazards and benefits are positioned throughout the board by way of pieces that are in a normally face-down presentation relative to the board such that the character of the pieces is unknown until contact is made by the representative village tokens.

1 Claim, 3 Drawing Sheets

| | DEMURANS | ELDO | SLIKE | DACAB | RUMARL (BULL) | TSUNAMI | SKALTER |
|---|---|---|---|---|---|---|---|
| DEMURAN (ON FOOT) | — | KILLED REMOVE | KILLED REMOVE | LEAVE OR PUT A TOP PIECE | GORED REMOVE | | SAVE STACK A TOP YOUR PIECE |
| DEMURAN (MOUNTED) | — | | | | | | |
| GORLA | | KILLED REMOVE | | | | | |
| ULF | — | GO BACK 1 | REMOVE SLIKE | — | — | RETURN HOME | |

FIG. 11

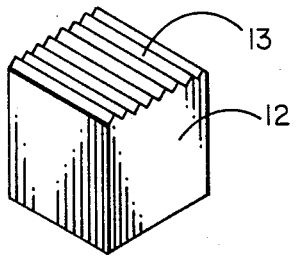

| CATEGORY | TOKEN | CATEGORY | TOKEN |
|---|---|---|---|
| 1st ANCIENT | (1) | 18th FEVIN | (3) |
| 2nd LETIC | (1) | 19th SLIKE | (4) |
| 3rd MAN | (1) | 20th WAZEEN | (3) |
| 4th WOMAN | (1) | 21st ELDO | (2) |
| 5th GIRL | (1) | 22nd TERRIK | (2) |
| 6th BOY | (1) | 23rd TSUNAMI | (1) |
| 7th RUMARLS | (4) | 24th RAIN | (1) |
| 8th GORIAS | (4) | 25th SNOW | (1) |
| 9th ULFS | (2) | 26th HAIL | (1) |
| 10th IYLDAKS | (2) | 27th SANDSTORM | (1) |
| 11th OPTREX | (2) | 28th FIRE | (1) |
| 12th HYIBOE | (1) | 29th FALLING REDLUTS | (1) |
| 13th RIGOBAR | (2) | 30th MORLUT | (6) |
| 14th SKALTER | (2) | 31st DACAB | (8) |
| 15th SADDLES | (4) | 32nd FROTH | (6) |
| 16th BEES | (3) | 33rd YORLA | (8) |
| 17th MOSQUITEIDS | (3) | 34th DEMURAN FAULT LINE | (1) |

FIG. 3

EDUCATIONAL GAME EMPHASIZING HARMONY

BACKGROUND OF THE INVENTION

1. Field of the Invention

The field of invention relates to educational games, and more particularly pertains to a new and improved educational game emphasizing harmony wherein values of concern and caring for all of the players of the game is emphasized.

2. Description of the Prior Art

Games of the prior art have emphasized the competing and overcoming obstacles for personal gain. These devices have tended to emphasize the conflict and competitiveness in society with attendant deleterious results without a balancing of a teaching model to emphasize a harmonious interaction among individuals. For example, U.S. Pat. No. 1,095,433 to Stevens sets forth a travel-type game wherein the object of the game is to overcome obstacles in a canal zone on a game board ahead of a competing player wherein the opposing player's loses are to the other player's gain.

U.S. Pat. No. 2,729,451 to Larson Wherein a player throws a plurality of dice to display certain color combinations whereby a player may make an advantageous move while perpetrating disadvantage upon an opponent. This is contrary to the teachings of the instant invention wherein disadvantage to an opponent does not advantage the opposing player and the opposing player's attainment of personal goals.

U.S. Pat. No. 3,347,550 to Carboni sets forth a map game utilizing checkers wherein as in a checker game the map game is won by a player eliminating opponents while traversing the board.

U.S. Pat. No. 3,810,615 to Miller sets forth an educational type game wherein the object of the game is to raise a player's space ship into a launched position by attaining a point goal by responding correctly to certain questions presented throughout the game and attaining the appropriate number of points.

U.S. Pat. No. Des. 270,258 to Iwaya sets forth an ornamental game board illustrating the various features of a geographical type setting.

As such, it may be appreciated that there is a continuing need for a new and improved educational game emphasizing harmony among players as opposed to discord and conflict. The instant invention sets forth the teachings that while of somewhat increased difficulty, it is rewarding to know that a player can proceed and succeed within a game without harm to opposing players wherein those opposing players can also succeed without harm to other players. And in this regard, the present invention substantially fulfills this needed teaching ethic.

SUMMARY OF THE INVENTION

In view of the foregoing disadvantages inherent in the known types of educational games now present in the prior art, the present invention provides an educational game emphasizing harmony wherein the same utilizes a game board including geographical type hazards in requiring opposing villages of harmonious type individuals to traverse the game board to reach an opposing HOME position. As such, the general purpose of the present invention, which will be described subsequently in greater detail, is to provide a new and improved educational game emphasizing harmony which has all the advantages of the prior art educational games and none of the disadvantages.

To attain this, the present invention comprises a game board including a plurality of opposed HOME spaces within a matrix of spaces of a game board including water and land geographical barriers. The tokens representing various aspects of a harmonious social entity attempts to traverse the game board with a need to acquire various elements, such as food, etc., from a series of "unknown" tokens positioned face down to provide an element of chance in the traverse of the game board. The "unknown" tokens are of an advantageous and disadvantageous grouping to add suspense to the game. Social harmony and interrelationships are positive attributes taught in the course of playing the game.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved educational game which has all the advantages of the prior art educational games and none of the disadvantages.

It is another object of the present invention to provide a new and improved educational game which may be easily and efficiently manufactured and marketed.

It is a further object of the present invention to provide a new and improved educational game which is of a durable and reliable construction.

An even further object of the present invention is to provide a new and improved educational game which is susceptible of a low cost of manufacture with regard to both materials and labor, and which accordingly is then susceptible of low prices of sale to the consuming public, thereby making such educational game economically available to the buying public.

Still yet another object of the present invention is to provide a new and improved educational game which provides in the apparatuses and methods of the prior art some of the advantages thereof, while simultaneously overcoming some of the disadvantages normally associated therewith.

Still another object of the present invention is to provide a new and improved educational game emphasizing harmony wherein the same attempts to teach harmonious social interaction de-emphasizing conflict and aggression in accommodating opposing players.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a top orthographic view of a chart for plotting the existence and removal of the various player tokens of the instant invention.

FIG. 3 is an isometric illustration of the tokens of the instant invention.

DESCRIPTION OF THE PREFERRED EMBODIMENT

Figure 1:
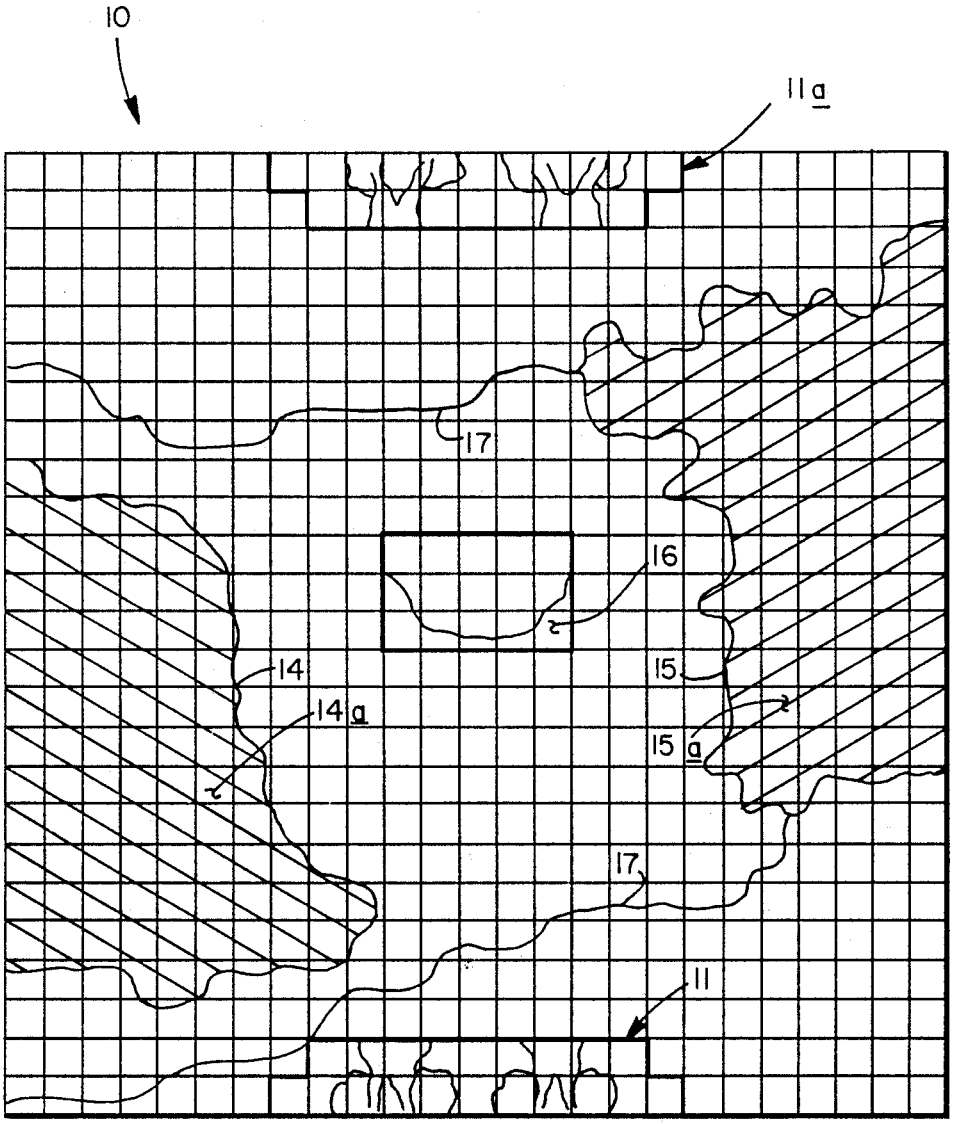
FIG. 1 is a top orthographic view of the game board of the instant invention.

With reference now to the drawings, and in particular to FIG. 1 thereof, a new and improved educational game emphasizing harmony embodying the principles and concepts of the present invention and generally designated by the reference numeral 10 will be described.

The game has its essence based upon the precept that opposing groups or villages of people designated as Demurans may coact and coexist without harm to opposing groups. The Demurans include six tokens to represent a cross-section of a typical village. The village further comprises four Rumarls, four Gorlas, two Ulfs, and two Iyldaks. Accordingly, eighteen tokens are positioned upon the HOME spaces 11 and **11*a* of the game board 10. The game board 10 itself comprises 625 squares of appropriate dimension to accommodate the tokens 12. The tokens 12 are formed with upper serrated surfaces 13** to enable a piggyback accommodation of one token upon another, for purposes to be understood in the playing of the game, as discussed below.

Each respective HOME section 11 and **11*a* includes twenty squares medially positioned in an opposed relationship at opposite ends of the board 10**. Eleven squares positioned adjacent an edge of the board with nine spaces positioned thereon. Each village comprises eighteen tokens and thereby enables latitude for a player to position the village tokens, as desired.

For clarity, of the opposed villages of Demurans is designated by a first token representing the Ancient, a second token representing the Letic, a third token representing the Man of the Village, a fourth token representing the Woman of the Village, a fifth token representing a Girl of the Village, and a sixth token representing a Boy. A series of four seventh tokens represent the aforenoted Rumarls, four eighth tokens represent the aforenoted Gorlas, two ninth tokens represent the Ulfs, and two tenth tokens represent the aforenoted pair of Iyldaks. Each player is thereby provided with eighteen tokens representing the various figures comprising each respective village to position within the respective HOME spaces 11 and **11*a***.

The board comprises a first border area 14 positioned adjacent a first side of the game board to include a predetermined number of squares **14*a*** representing a sparse land. The sparse land is to represent a vast steppe land that is ostensibly barren to represent an area of limited vegetation and of great danger to the aforenoted village comprising the Demurans, and their associated animals represented by the seventh, eighth, ninth, and tenth tokens.

A second border area 15 positioned adjacent a second opposed side of the game board opposite that of the first side includes a plurality of squares **15*a* to represent the Great Watery Waste depicting the Demuran Ocean. This Ocean area is also of danger to the respective villages and similarly to the sparse land spaces 14*a*** representative of a region not to be entered into by the village tokens.

A section centrally located within the game board of spaces 16 defines a further area denoted as Mount Jumi to indicate a third geographical area of fifteen squares not to be entered into by the various village tokens. Positioned in a meandering fashion adjacent each respective HOME section 11 and **11*a* are rivers 17. These rivers are of limited thickness to enable the tokens to utilize the squares containing the rivers 17** and are presented within the game board to provide dramatic effect of the geographical nature of the game board.

The tokens 12 are utilized to represent thirty-four categories of Figures. The first through tenth categories of tokens from the village will be described. The first categories of tokens depicting the Ancient is utilized to connote the spiritual and wisdom aspects of the Demuran village tokens wherein the Ancient or first token of the tokens 12 are associated with an eleventh category of token set forth as the Optrex. There are two eleventh Optrex tokens which are subject to destruction by each of the seventh tokens or the four Rumarls. The Optrex tokens are conduits of knowledge for the first tokens or Ancient token utilized by each player.

Each player is provided with one second category of token or Letic wherein these second tokens are a category including teachers, priest, and counselors associated with each Demuran village. The third, fourth, fifth, and sixth token or the respective categories of Man, Woman, Girl, and Boy complete the Demuran family of villagers.

A seventh category of token provided each player comprises four Rumarls cows. These seventh tokens are representative of slowly moving bovines and they move only one square at a time and never on a diagonal between squares. These tokens may be moved a maximum of three consecutive times prior to a forced move of another token. As grazing is not enough for these tokens, food must be found from the series of "unknown" tokens, to be discussed in more detail below. The Rumarls will panic and stampede back to a respective HOME spacing if any of them encounter Fire, Sandstorm, Hail, Slike, or Tsunami of the group of "unknown" tokens, to be discussed in more detail below. Further within the "unknown" tokens, encounters with the tokens Eidos, Terriks, and Fervins representative of twenty-first, twenty-second and eighteenth category of tokens within the "unknown" token group. These tokens will kill Rumarls requiring removal of a respective Rumarl from the game board upon such an encounter.

Included within the grouping of four Rumarls is a Rumarl-Bull. The hazard of the Rumarl-Bull is that it will gore Demuran tokens from an opposing village requiring the removal from the game board. Further, the Rumarl-Bull will attack and kill the eighth category of token (Gorlas) when the Gorla is secured to the thirteenth category token (Rigobar), a wagon. Food may be encountered for the Rumarl-Bull in the form of the thirty-third, thirty-first, and thirtieth respective category of "unknown" tokens, specifically the Gorla, the Dacab and the Morlut. The greatest danger from the Rumarl-Bull is its encounter with the necessary game crystal or eleventh category of token (Optrex).

The eighth category of token comprises four Gorlas utilized by each opposing player wherein the Gorlas are essentially a beast of burden but may be ridden as well as transport various food items from the category of "unknown" pieces comprising the eleventh through thirty-fourth categories of tokens. Specifically, they may transport the twenty-ninth category of token or Falling Redlut for subsequent food requirements. The Gorlas will eat the thirty-third, thirty-first, and thirtieth category of token, or specifically the Gorla, the Dacab, and the Morlut. The encounter with the category of tokens set forth as the twenty-sixth, twenty-seventh, and twenty-eighth category of tokens, specifically Hail, Sandstorm, and Fire will send the respective encountering Gorla back one square or to the nearest open square rearwardly of the encounter. The Gorla will kill and remove the nineteenth category of token or the Slike. The Gorla is subject to removal from the board by encounter with the twenty-first and twenty-second category of token, or specifically Eido and Terrik. Encounter with the Rumarl-Bull within the seventh category of token will require the Gorla token to back off one square or to the nearest open square rearwardly of the encounter with the Rumarl-Bull. When secured to the thirteenth category of token or Rigobar, the Gorla is subject to removal from the board upon encountering the Rumarl-Bull.

The ninth category of the tokens 12 comprises two Ulfs for each player wherein the Ulf is representative of a pet canine. The canine may move one square at a time including on a diagonal but may not be along in a diagonal to encounter another piece or token. It may be moved as many as four consecutive times prior to moving another token. The Ulf may eat the nineteenth category of token or Slike (snake). Encounters with the thirty second category of token or Froth (a Demuran food) will effect the removal of this token from the board and removal of a necessary food for the Demuran tokens. Encounter with the eighteenth and twentieth category of token, or Fervin and Wazeen respectively, will kill the Ulf and require its removal from the board. Encounter with the twenty-second, twenty-seventh, and twenty-eighth category of the tokens 12 from the grouping of "unknown" tokens, or specifically Hail, Sandstorm, and Fire, will require the repositioning of the Ulf back to its respective HOME section. Encounters with the twenty-first and twenty-second category of token, or Eido and Terrik, will back off the Ulf one square or to the nearest open square rearwardly of the encounter. The Ulf tokens and the tenth category of tokens, or Iyldaks, require no food tokens to enter the new or opposed HOME section and are designated to live off the land.

The tenth category of tokens comprises to Iyldaks for each player which are essentially representative of song birds and may move one square at a time including diagonally, but with no more than three consecutive moves with any one of the Iyladaks tokens. The tenth category of token will consume the sixteenth and seventeenth category of tokens, or Bees and Mosquiteids, which are of danger to the Demuran tokens. It will also consume the thirty-third category of token, or Yorla (wheat), which is needed to feed the other village animals or tokens, seventh and eighth. Further, the tenth category of token will consume the thirty-first category of token, or Dacab, which may be food for the animals of the village people. Encounter with the twenty-sixth category of token, or Hail, and the twentieth category of token, Wazeen (the vulture of the Demuran world), will kill the tenth category of token, or Iyldaks. Encounter with the twenty-fifth, twenty-eighth, and twenty-seventh category of token, or Snow, Fire, and Sandstorm, will send the Iyldak back to the respective HOME section, as will encounters with the twenty-first and twenty-second category of token, or Eido and Terrik. The twelfth category of token, or Hylboe (the mighty eagle), will also eat the Iyldaks and requires removal from the board.

There is a pool of sixty-seven "unknown" pieces scattered about the board at the outset of the game between the respective HOME sections. Their function and listing are as follows:

Optrex (11th token) 2 tokens
Hylboe (12th token) 1 token
Rigobar (13th token) 2 tokens
Skalter (14th token) 2 tokens
Saddles (15th token) 4 tokens
Bees (16th token) 3 tokens
Mosquiteids (17th token) 3 tokens
Fervin (18th token) 3 tokens
Slike (19th token) 4 tokens
Wazeen (20th token) 3 tokens
Eido (21st token) 2 tokens
Terrik (22nd token) 2 tokens
Tsunami (23rd token) 1 token
Rain (24th token) 1 token
Snow (25th token) 1 token
Hail (26th token) 1 token
Sandstorm (27th token) 2 token
Fire (28th token) 1 token
Falling redluts (29th token) 1 token
Morlut (30th token) 6 tokens
Dacab (31st token) 8 tokens
Froth (32nd token) 6 tokens
Yorla (33rd token) 8 tokens
Demuran Fault Line (34th token) 1 token

OPTREX TOKEN

These are giant crystals with which the Ancients obtain all knowledge. Obviously, they are invaluable. There are only 2; one for each player. Great care must be taken of these. The Rumarl bulls will smash them if they meet. The Optrex must be loaded onto a wagon, the Rigobar, to be moved.

HYLBOE TOKEN

This token is representative of an enormous eagle as a friend of the Demuran people.

If one of the Demurans, meets the Hylboe, that player then has control of the majestic bird. The Hylboe has special powers. It is, in fact, the most powerful creature in the land, and the most powerful piece in the game of Harmony. Once you have gained control of the Hylboe, however, it must again be placed face down. Then whenever you choose to make a move with it, you must announce a "Hylboe move". When you have made that announcement, you must show the face of the Hylboe to the other player, showing that it is, indeed, the Hylboe that you are moving. Don't forget where it is once you have control. If you make the announcement, but show anything but the Hylboe, You lose control of it.

If a player loses control of the Hylboe, the great bird must be placed at one side of the board—either over the Great Watery Waste or over the Sparseland.

SKALTER TOKENS

This is actually the stomach of a huge flesh-eating fish, called the Skalt, that lives in a salty inland lake in Demura. The people treat these in a special way and then use them for canteens when they travel, or when they work in their fields. It was like acid to them. The Demurans filled their skalters with salt water and used them like squirt guns against the invaders. There are still a couple of them lying about the land, ready to be used again. They can be used only once, and only by the individual who has possession of it. If one of the Demuran tokens meets a Skalter, save it. Place that person atop the Skalter. If that Demuran should meet a Terrik or an Eido, the Skalter can be used to eliminate the giant cannibal tokens. Once it is used, however, you must discard it from the game.

RIGOBAR

These enormous Demuran wagons are useless without the Gorla. The people use them to haul their many crops from the fields to their homes in the villages. They are used for transport, too, carrying goods from one village to another for trade, and to help those villages that are in need. If you meet the Rigobar, you must turn it face down again, but remember where it is. You will need it. Although it is placed among the Unknown pieces at the start of the game, the Rigobar is described in the section on each Player's pieces. A Rigobar token is a unique Demuran wagon, which is pulled by their Gorla token. To obtain possession of a Rigobar token, a Gorla who is being ridden must be brought adjacent to the Rigobar, and then a move used to hitch the animal to the wagon. The Rigobar piece is then used as a base for the other pieces. With the Rigobar, three Demurans may ride thereon provided nothing else is being carried. With the Rigobar, you are again limited to one square at a time, and only on the rank and file. No diagonal moves because these Demuran wagons are rather cumbersome.

Meetings will still be determined according to the rules applying to the Gorla.

The best use of the Rigobar, though, is to use it to transport the Optrex, which is somewhere in the pool of Unknown pieces. Without the Rigobar, in fact, it will be impossible to get the Optrex to your new home. When the Optrex has been located, the Rigobar must be brought to an adjacent square. Then you must use another move to load the precious stone on the Rigobar. With the Optrex aboard the Rigobar, only 1 Demuran may ride. All meetings are still determined according to the rules applying to the Gorla.

TSUNAMI TOKENS

This is what is mistakenly called a tidal wave. Great waves roll across the ocean, usually caused by eruptions deep in the Great Watery Waste somewhere. The Tsunami can be devastating to the Demuran people and their land. If a Demuran, Ulf, Rumarl or Gorla token meets the Tsunami, all will flee back to the original HOME section. All people and animals, except the Iyldak (and the Hylboe if it is in your control) will have to start all over again.

REDLUT TOKENS

These are delicious Demuran apples, of a sort. To the tiny Demurans, the Redlut is an enormous fruit. One is sufficient for numerous pies. Their size, though can create a hazard for the Demuran people. They have to be very, very careful when harvesting their orchards. The greatest danger is from isolated trees along the paths. A falling Redlut such as this can cause serious injury. In this case, it will result in a dislocated shoulder. That individual will have to return to the original HOME section and heal before starting the journey again. The person will need the services of a Letic, who is knowledgeable in medicine. If that is not possible, take your Ancient Home with the injured person. If that isn't possible, either, the Demuran will have to remain there until an Optrex is available. From that he or she could attempt to doctor himself, or herself. Without an Ancient, Letic or Optrex, the Demuran will never be able to travel again.

DEMURANS MAY GAIN A MOUNT

If one of the Demuran people meets a Saddle token, that individual can maintain possession of it. A meeting can then be arranged between that person and one of the players own Gorla tokens. When they are side by side, a move can be used to mount the person on the Gorla. Two people can ride a Gorla. To get a second person aboard, the same requirements stand: the person must be brought next to the Gorla and then a move used to get him atop the Gorla.

MOUNTED

While they are riding the Gorlas, the Demurans have the ability to move on the diagonal, too, but still only one square at a time. They may also move on two successive turns of a player, but no more than two in a row.

IYLDAKS

These are colorful little songbirds. They brighten the lives of the Demuran people. Many are pets, and they serve as a warning to the people when dangerous creatures are near.

They can move one square at a time, including diagonally. No more than 3 consecutive moves with any one Iyldak.

This little bird will feast on Bees and Mosquiteids, thus eliminating those nuisances to the people. Be careful, though. It will also eat Yorla, the Demuran version of wheat. You will need that for your other animals. The little songbird will also eat Dacabs, which can be food for animals or people.

Only 2 things can kill the beautiful little bird, forcing you to remove it from the board; Hail and Wazeens, the ugly vulture of the Demuran world.

Snow, Fire, and Sandstorms will frighten the little bird and send it winging all the way back to the original HOME section, as will Eidos and Terriks, the evil giants from beyond the mountains, who lurk somewhere in the Unknown pieces.

Another thing to beware of is the Hylboe. That mighty eagle will also eat the songbird, so be aware of that, too.

ULFS

These lovable little canines are the perfect watchdogs, and the friendliest of pets. They are a favorite of the Demuran people. Their shrill bark is also a warning to the people of approaching dangers.

Move one square at a time, including the diagonal, but cannot "meet" another piece on the diagonal. It has considerable endurance and can make as many as 4 consecutive moves.

This fluffy canine has a special digestive system that permits it to eat Slikes, the poisonous snakes that are such a threat to the people. But keep a close watch on this pet. Ulfs will also eat the delectable Froth, the special stew that the people love and need.

Wazeen and Fervin (a cousin to the extinct Sabretooth Tigre) will kill the Ulf in meetings.

Hail, Sandstorms, Fire, and Tsunami will send it all the way back to the original HOME section.

Eidos and Terriks will scare it. Back off one square, or to the nearest open square behind the meeting.

Ulfs and Iyldaks are the only creatures that need not have food items to enter the new HOME section. Both have the ability to live off the land.

FERVIN TOKENS

These are representative of vicious cats, were chased into Demura by the Eidos and Terriks when they invaded the land long ago. They will kill people, Ulfs 9th, and Rumarl cows 8th, Dumuran people are safe, however, if they are riding a Gorla or aboard a Rigobar.

Can only be killed by the Hylboe.

SLIKE TOKENS

These venomous little serpents have a bite that is deadly to all people. They will also frighten Rumarl cows and cause a stampede. That will cause all people and all their animals (except the Iyldak and Hylboe, if it is in your control) to return to the original HOME section.

Slikes are eliminated by Hylboe, Iyldak, Gorla, and Ulf.

WAZEEN TOKENS

Is representative of a vulture and is a daily threat to all people. It will also prey on the Ulf and Iyldak. People are safe only if they are riding a Gorla or Rigobar.

Only the Hylboe can kill this mighty buzzard.

EIDO AND TERRIK TOKENS

These are the evil giants from beyond the Great Dividing Mountains. Long ago they invaded the land. These are giants, standing four feet tall—twice as tall as the Demuran people. They are cannibals and had started the ancient war in the hopes of enslaving the chubby little Demuran people and raising them as herds, to serve as a delicacy for their tables back in their unknown land. They were defeated, but a few of these evil giants escaped into the wilds of the land of Demura. They could not find their way back to their own land and their own people. The still lurk in Demura, still living in their old, bloodthirsty ways. They still prize Demuran people as the best of means and will eliminate any people that meet them. They are also a threat to the animals of the people. They will butcher any Rumarl—cow and bull—and Gorla that they meet. They will scare the pretty little Iyldak and send it all the way back to the original HOME section. They will also frighten the Ulf, but it will only back off one square.

SADDLE TOKENS

This is a necessity before a person can ride the huge Gorla. If a Demuran meets a Saddle, he or she will keep it. Set your person atop the Saddle. To mount, that person then must be brought alongside a Gorla. Then a move must be used for a Meeting. On that move, place Saddle and person atop the Gorla. Moves from then on are governed by rules applying to the Gorla. You may pick up one more rider. Person must be placed alongside Gorla, then another move used to get the person aboard. It should be placed on the outer rank of squares, on the one nearest the player who just lost control, but within the Watery Waste or Sparseland. It makes no difference which you choose because it will take the same amount of moves, and squares, to get it out of either.

Control then switches to the other player, who must then make the same announcements, and always show the piece before moving it.

How the HYLBOE moves:

The mighty Hylboe can move 2 squares at a time, including two on the diagonal. It must always move in a straight line, though. You cannot, for example, move one square ahead and then one on the diagonal. It need not move 2 squares, however. If you choose, it may move only one square during a turn. It can then meet pieces on any adjoining square, including pieces on the diagonal. It can also cross an open square and meet a piece at the square to which it has the capability to move.

This mighty eagle gobbles up Bees (16th category of token), Mosquiteids (17th category of token), and Slikes (19th category of token). It even kills the vicious Fervin and Wazeen (20th). Be careful, though, this master of the air will also eat the lovely little Iyldak (10th).

Nothing can kill the Hylboe, but there are hazards. Eido (21st) and Terrik (22nd) will try, but their weapons cannot reach it. They will, however, succeed in frightening the mighty eagle. If you meet one of these evil men with the Hylboe, take the great bird and place it near your original HOME section. It is placed on any square adjoining a respective starting HOME section, and that player maintains control of the Hylboe.

There are natural hazards to the Hylboe and they will cause you to lose control of the Hylboe. Precipitation makes flying difficult. Hail (26th), Rain (24th) and Snow (25th) will make the Hylboe head for the dry regions of the Sparseland. Move it to the outer edge, the same as in other circumstances where you lose control. Control of the Hylboe now switches to the other player.

Another hazard is the Sandstorm which occasionally blows in across the land from the Great Sandy Waste. The hylboe will then head for the moist regions over the Great Watery Waste. It is then moved to the outer edge of the Watery Waste, on the square nearest the player. Control then switches to the other players.

Whenever a player loses control of the Hylboe and it is in the regions of the Sparseland or the Great Watery Waste, it can only be moved one square at a time until it is out of those regions. Once clear of those places, it resumes its normal capabilities.

Throughout the game, whether it is in play or over the Sparseland or Great Watery Waste, there must always be a minimum of 3 moves by a player between Hylboe Moves.

BEES AND MOSQUITEIDS TOKENS

These are a hazard only to the Demuran people. They will force the people to retreat 2 squares. They are eaten (removed from board) by Hylboe (24th) and Iyldak (10th).

FROTH TOKENS

This is a very special Demuran stew. People need to have food before they can enter the new HOME. this will suffice. It is their favorite, in fact. Place the person atop the Froth and continue. If the person already has an appropriate food item, it might be best to leave it. Whenever a Demuran meets a food item, though, he or she has a choice as to whether or not they wish to keep it or leave it.

There are hazards for the Froth in this game, though. Ulfs also love the stew. They, too, will eat the Froth.

MORLUTS TOKENS

These enormous Demuran potatoes are the other food item that will enable the people to get into their new HOME. Here, too, there are hazards. All of the Rumarls and Gorlas find the Morluts irresistible, too. If they meet a Morluts, they will devour it.

DACABS

This is a spicy vegetable, something like a giant radish. It can be food for the animals or for the Demura people. The Iyldak, who does not need food to enter the new HOME, will feast on any Dacab it encounters. The Gorlas and the Rumarl bull will also devour the Dacab.

YORLA

This strange Demuran cereal grain is a staple, but it cannot be used while the people are journeying across the land. Demurans will ignore it. It is the perfect food for the Rumarls and Gorlas, though. The little Iyldak will also eat the Yorla it meets, so be careful of that.

RAIN

Rain bothers none of the creatures of people. It will, however, send the mighty Hylboe to the dry Sparseland.

SNOW

This will send the people back 1 square, if they are on foot. It will send the Iyldak all the way back to the original HOME. and the Hylboe will fly to the Sparseland.

HAIL

The Demuran people, if they are on foot or riding, will go back one square. Gorlas, too, back up 1. The Ulf will run all the way back HOME. It will kill the Iyldak, and the Hylboe will again head for the Sparseland. It will cause a Rumarl cow to start a stampede.

SANDSTORM

This will cause the Rumarl cows to stampede. Gorla and Demurans will back up 1 square. Ulf and Iyldak will scurry all the way back HOME, and the Hylboe will soar out over the Great Watery Waste.

FIRE

This, too, will cause the Rumarl cows to stampede, Ulf and Iyldak will also go all the way back HOME. Demurans and Gorlas will back off 1 square.

FAULT LINE

In Demura, there is a long Fault. This is a long, winding weak spot in the earth's crust, caused by ancient earthquakes. Mild tremors sometimes widen these cracks. In places, the open cracks have been covered with growing brush. This is one of those spots. Brush hides this crack in the fault. The animals somehow sense this and it is no danger to them, but it is hazardous to the people. If a Demuran meets this Fault Line, they will fall through the brush that hides it and break a leg. They will have to return to the Original HOME until the leg can heal. A Letic must also return, or an Ancient, or the Optrex. One of those 3 is needed in order for the person to be healed.

Another hazard is to the Rigobar. This will cause a broken axle. You will have to return to the original HOME for repairs. You may, however, simply place the Rigobar, Gorla and people back in the HOME section and they can begin anew with your very next move if you wish.

Upon a Demuran token encountering the fifteenth category of token, or Saddle, that individual may obtain possession of it and upon a meeting arranged between one of the players and his respective Gorla or eighth category of token, that player may ride the Gorla whereupon as many of the two Demuran tokens may ride a single Gorla. When the Demuran token and the Gorla are side by side on two respective unoccupied squares of the board 10, the player may mount that respective Gorla whereupon as many as two may mount the Gorla with the same requirement of positioning the Gorla in a side by side relationship to that player. When a village Demuran is above the Gorla they may also move it on a diagonal with the Gorla, but only one square at a time and may proceed on that Gorla on two successive turns, but no more than two in a row.

In this manner, the players attempt to move the respective village of eighteen original tokens comprising the first through tenth category of tokens plus the eleventh category of token, or Optrex, into the new HOME. Play proceeds until both opposing players have attained this goal. A player may venture back out onto the board surface playing area subsequent to entering the new HOME section should that player desire to continue play until the opposing player also reaches and attains the respective goal of moving his village plus the Optrex into the new HOME section. When an animal or person enters their new HOME section, the food items they have brought with them are discarded from the game.

There are therefore 103 pieces required for each game including the original thirty-six village people plus the sixty-seven "unknown" pieces. The pieces may be interlocked and stacked as necessary, such as the Demuran village people mounting a Gorla or riding within the Rigobar or thirteenth category of token (wagon).

The pool of "unknown" pieces are scattered in the center of the board at the start of the game and should have their symbols on the bottom facing the board thereby being indistinguishable from other tokens on the board to enhance the element of chance and mystery in playing of the game. Each of the category of tokens 1 through 34 are provided with symbols to indicate their respective category on the face in contact with the board, but the respective village of tokens comprising the first through tenth category of tokens may also have symbols on a side facing that respective player to provide that player with knowledge of the token, but that token will remain unknown to the opposing player.

It is desirable to utilize a chart, as indicated in FIG. 2, as an example to enable a respective player to maintain understanding of the fate of each of this village tokens and understand remaining potential hazards to enable formulation of strategies to reach the opposing HOME section of squares 11 or 11*a* with that player's respective village tokens.

The manner of usage and operation therefore of the instant invention should be understood from the above description and accordingly no further discussion relative to the manner of usage and operation of the instant invention shall be set forth.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows

1. A method of playing a game emphasizing harmony among players comprising the steps of, providing a game board defined by a square matrix of 625 total squares with opposed ends of the game board including medially positioned twenty squares defined as respective HOME sections for opposing players, and wherein each player is awarded a group of eighteen tokens for positioning within each HOME section and wherein each player alternatively moves respective tokens across the surface of the game board to terminate play in an opposing player's HOME section, and wherein the eighteen tokens comprise a village, and each village includes ten categories of token comprising a first through tenth category of token, and wherein a further sixty-seven tokens are positioned on the various squares of the game board defining an eleventh, twelfth, thirteenth, fourteenth, fifteenth, sixteenth, seventeenth, eighteenth, nineteenth, twentieth, twenty-first, twenty-second, twenty-third, twenty-fourth, twenty-fifth, twenty-sixth, twenty-seventh, twenty-eighth, twenty-ninth, thirtieth, thirty-first, thirty-second, thirty-third, and thirty-fourth category of tokens, and providing an eleventh token for each group of village tokens wherein in traversing the game board each group of village tokens must acquire a respective eleventh category of token to enable completion of the game, and positioning said eleventh category of token within an opposing player's HOME section, and wherein the sixty-seven tokens define unknown tokens positioned in a face-down relationship onto the game board to mask their identity, and wherein these unknown tokens define the eleventh through thirty-fourth category of tokens include hazards as well as benefits necessary to the traverse of the game board by opposing players, and when a village token lands on a space occupied by an unknown token, the identity of the unknown token is revealed providing said hazard or benefit to the village token, and wherein the game is completed upon each opposing player successfully traversing the game board and accordingly promoting the precepts of harmonious interaction between the players to minimize conflict therebetween.

* * * * *